United States Patent [19]

Bonicelli, Jr.

[11] Patent Number: 5,054,337

[45] Date of Patent: Oct. 8, 1991

[54] RING-PULLER

[75] Inventor: Derito J. Bonicelli, Jr., Indianapolis, Ind.

[73] Assignee: Eli Lilly and Company, Indianapolis, Ind.

[21] Appl. No.: 630,691

[22] Filed: Dec. 20, 1990

[51] Int. Cl.[5] ..... B67B 7/00

[52] U.S. Cl. ..... 81/3.07; 81/3.55; 81/3.4

[58] Field of Search ..... 81/3.07, 3.4, 3.55, 81/3.57; 7/151

[56] References Cited

U.S. PATENT DOCUMENTS

| | | | |
|---|---|---|---|
| 3,460,411 | 8/1969 | Dyer | 81/3.07 |
| 4,911,038 | 3/1990 | Ferrin | 81/3.4 X |
| 4,919,016 | 4/1990 | Hanegraff | 81/3.55 |

*Primary Examiner*—D. S. Meislin

*Attorney, Agent, or Firm*—James J. Sales; Leroy Whitaker

[57] ABSTRACT

A ring-puller tool for quickly and effectively removing a prophylactyic shroud having a flexible ring attached thereto and positioned on a vial containing medicament.

9 Claims, 2 Drawing Sheets

RING-PULLER

FIELD OF THE INVENTION

This invention relates to tools for engaging and pulling flexible rings and more specifically to engaging a pull ring attached to a prophylactic hood or shroud on the top of a vial in a drug delivery system.

BACKGROUND OF THE INVENTION

U.S. Pat. No. 4,614,515, incorporated herein by reference, discloses a drug delivery system which, in one of its embodiments, includes a prophylactic hood or shroud for protective placement on the top of a vial containing flowable medicament. The hood or shroud has a flexible pull ring to assist in its removal from the vial when the contents of the vial are to be administered. In the course of a day, health care or pharmacy personnel may, individually, be required to remove the hood or shroud from numerous vials. There is a need for a tool for efficiently and quickly removing the hood or shroud from such vials.

SUMMARY OF THE INVENTION

Provided is a tool or flexible ring puller having a grippable elongated element with a proximate end and a distal end, and a ring engaging member attached adjacent the distal end, the ring engaging member having means shaped to distribute force created in the pulling action on a ring to a sufficient area of the ring to avoid breakage of the ring.

DESCRIPTION OF THE INVENTION

Figure 1:
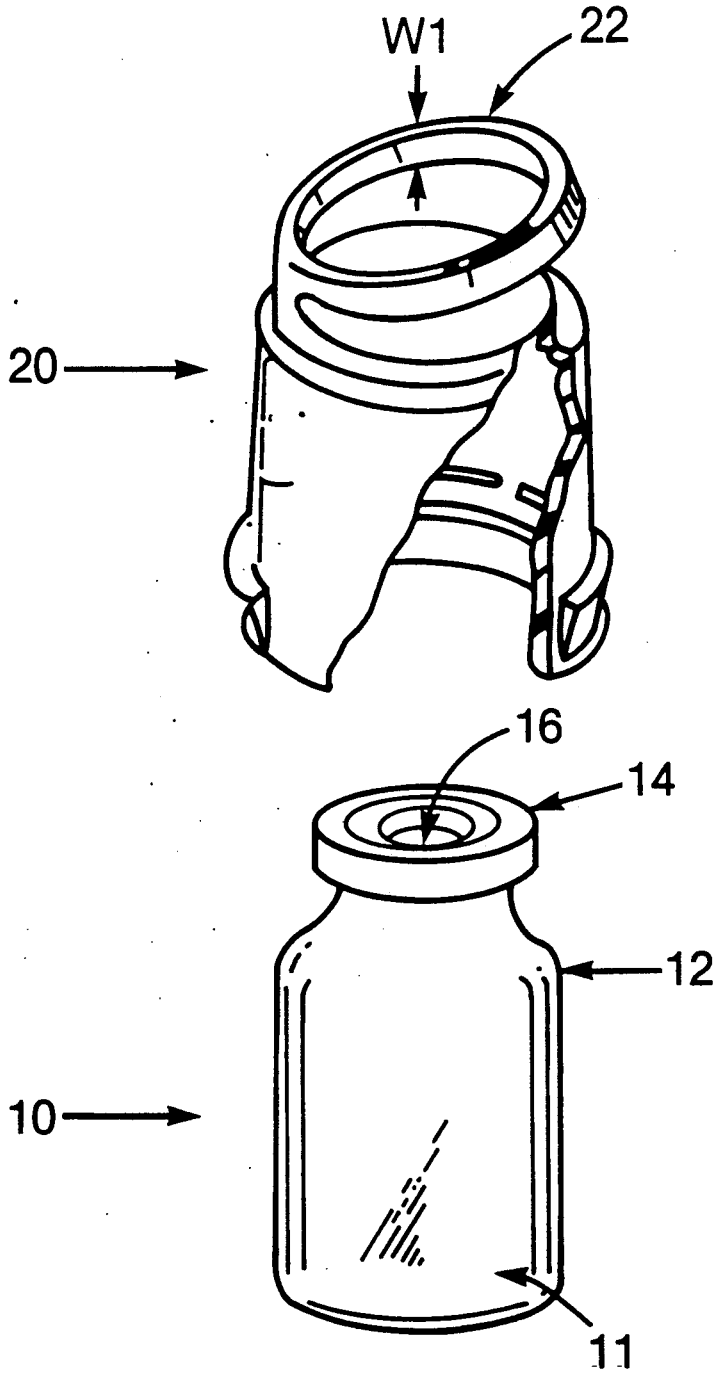
Fig. 1 Prior Art
FIG. 1 is an exploded partial view of a drug delivery system in U.S. Pat. No. 4,614,515.

Turning to FIG. 1, shown is a vial 10 having a lower portion 11 and an upper portion 12 which includes a stopper 14. The stopper 14 has a piercable diaphram 16 through which a cannula (not shown) may be inserted when the medicament contained in the vial 10 is to be disbursed.

Further shown in FIG. 1 is a prophylactic shroud 20 which is sized to snuggly fit over the upper portion 12 of the vial 10. Positioned at the top of the shroud 20 is a flexible pull ring 22 having a width W1. In most instances the shroud 20 and pull ring 22 are integral and formed of plastic. The pull ring 22 has an inside diameter which will easily allow a human finger to be inserted therein, and at least about ¾ of an inch.

Figure 2:
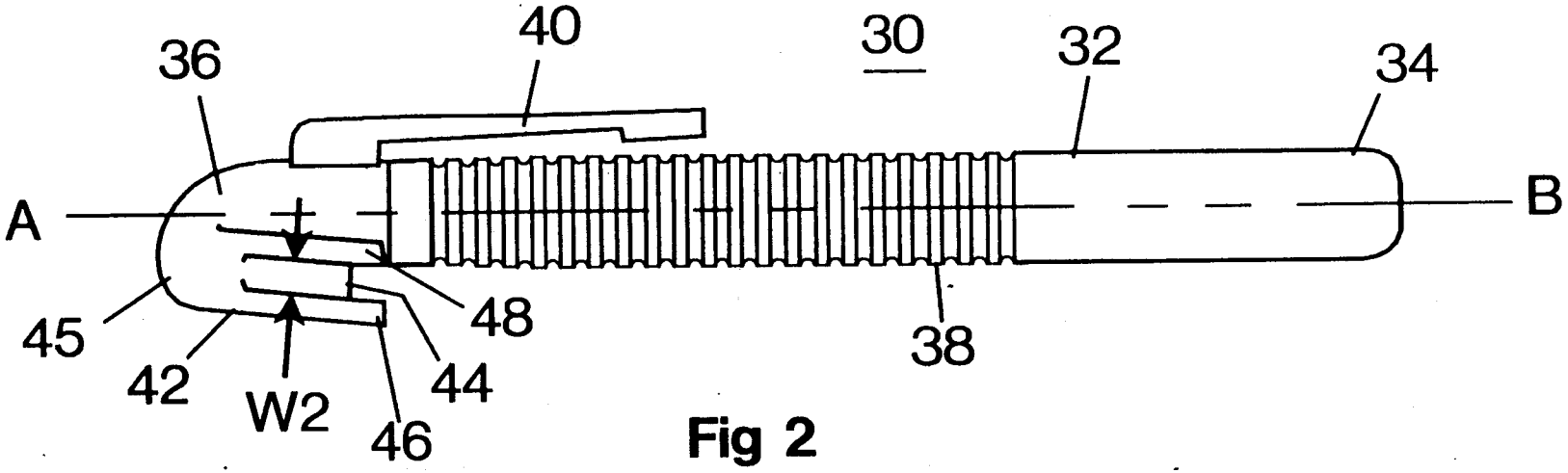
FIG. 2 is a side view of an embodiment of a ring puller.

FIG. 2 illustrates a preferred embodiment of the tool to assist in removing the shroud 20 from the vial 10, and is designated generally 30. The tool 30 includes an elongated member or handle 32 which has a proximate, gripping end 34, and a distal end 36. The handle 32 defines a longitudinal axis, A-B. The handle 32 also includes a textured section 38 for assisting in gripping the tool 30. In this embodiment, the texture is provided by a plurality of ribs. The handle 32 also includes a pocket clip 40 which is attached to the distal end 36 of the tool 30. This clip 40 allows a user to conveniently keep the tool 30 in a pocket along with probable numerous other pens and pencils, for ready use.

Figure 3:
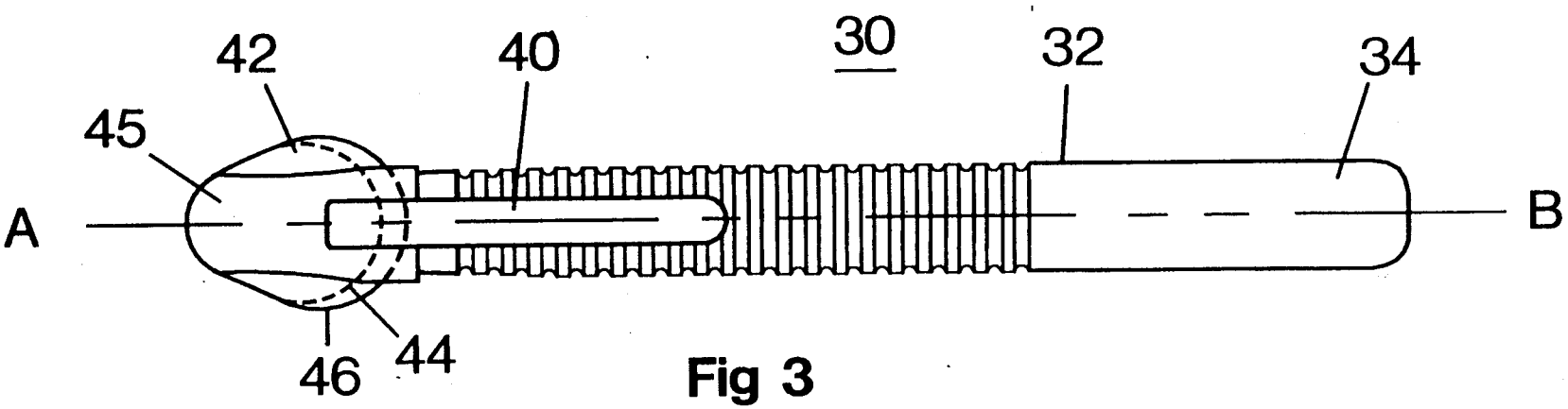
FIG. 3 a top view of the embodiment of the ring puller of FIG. 2.

At the distal end 36 of the tool 30 is a ring-engaging member 42 spaced from the handle 32. The ring engaging member 42 includes an arcuate or convex channel 44 facing toward the proximate end 34 of the handle 32 for engaging a ring, such as shown in FIG. 1, and has a width W2 wider then W1 (FIG. 1). The channel 44 is defined by a first outer ridge 46 and a second inner ridge 48 of the ring engaging member 42. Both ridges 46, 48 are arcuately shaped and correspond to the shape of the channel 44. More clearly shown in FIG. 3 is the substantially oval shape of the outer portion 45 of the ring-engaging member 42.

In operation, the user grips the proximate end 34 of the handle 32 and positions the ring 22 in the channel 44. The user, holding on to the bottom portion 11 of the vial 10, then pulls the tool 30 away from the vial 10, substantially along its longitudinal axis, from A to B.

It is an important feature of the invention that the ring engaging member 42 be shaped to distribute the force on the ring 22 (FIG. 1) from the pulling action to a sufficient area of the ring 22 to avoid breaking the ring 22. For example, when the ring 22 has a diameter of about an inch, and is formed of a flexible plastic, the convex channel 44 may have a radius of about ⅜ of an inch to engage a substantial portion of the ring 22 when the pulling action occurs, to avoid breakage. Other shapes and sizes of the ring-engaging member 42, and more specifically the channel 44, may be used, it being understood that an arcuate or convex channel 44 is preferred as it corresponds more directly to the shape of a ring 22.

The tool 30 is preferably of one-piece integral construction and may be formed by injection molding using a plastic such as polyethylene, polypropylene, or polyvinylchloride.

I claim:

1. A flexible-ring puller comprising:

a grippable elongated element having a longitudinal axis, a proximate end and a distal end;

a ring-engaging member attached adjacent said distal end, said ring-engaging member having means shaped to engage said ring and distribute force from a pulling action on said ring to a sufficient area of said ring to avoid breakage of said ring; and said means comprises a convex channel defined by a first inner ridge and a second outer ridge.

2. The ring puller as recited in claim 1 wherein said ridges are arcuate.

3. The ring puller as recited in claim 2 wherein said ring-engaging member has an outer substantially oval portion.

4. The ring puller as recited in claim 3 wherein said channel is positioned facing said proximate end of said elongated element.

5. A flexible ring puller comprising:

a grippable handle having a longitudinal axis, a proximate end and a distal end; and a ring-engaging member attached adjacent said distal end of said elongated handle, said ring-engaging member having a convex channel distanced from said handle for receiving said ring, said channel sized to distribute force from a pulling action on said ring to a sufficient area of said ring to avoid breakage of said ring.

6. The ring puller as recited in claim 5 further comprising a textured section between said proximate and distal ends.

7. The ring puller as recited in claim 5 further including a pocket clip.

8. The ring puller as recited in claim 5 wherein said ring-engaging member is substantially oval in shape.

9. The ring puller as recited in claim 8 wherein said convex channel is positioned facing said proximate end of said handle.

* * * * *